US005083164A

United States Patent [19]

Kamath et al.

[11] Patent Number: 5,083,164

[45] Date of Patent: Jan. 21, 1992

[54] DEVELOPMENT MODULE FOR A COLOR PRINTER

[75] Inventors: Venkatesh H. Kamath; Lam F. Wong, both of Fairport, N.Y.

[73] Assignee: Xerox Corporation, Stamford, Conn.

[21] Appl. No.: 666,955

[22] Filed: Mar. 11, 1991

[51] Int. Cl.[5] ..... G03G 15/06

[52] U.S. Cl. ..... 355/245; 355/327

[58] Field of Search ..... 118/645; 355/245, 326, 355/327, 88

[56] References Cited

U.S. PATENT DOCUMENTS

| | | | |
|---|---|---|---|
| 3,797,930 | 3/1974 | Tanaka et al. | 355/4 |
| 4,841,329 | 6/1989 | Kasamura et al. | 355/245 |
| 4,841,336 | 6/1989 | Kusumoto et al. | 355/245 |
| 4,939,547 | 7/1990 | Miyaji et al. | 355/245 |

FOREIGN PATENT DOCUMENTS

| | | | |
|---|---|---|---|
| 0002138 | 1/1979 | Japan | 355/326 |
| 0132355 | 10/1981 | Japan | 355/326 |

OTHER PUBLICATIONS

Co-pending U.S. Patent Application Ser. No. 07/485,011; Applicant: Borostzan; Filed: Feb. 26, 1990 (not available).

*Primary Examiner*—A. T. Grimley
*Assistant Examiner*—Patrick J. Stanzione
*Attorney, Agent, or Firm*—H. Fleischer; J. E. Beck; R. Zibelli

[57] ABSTRACT

An apparatus in which successive developer units are moved to a development zone to develop, with different color toner, successive latent images recorded on a photoconductive member. At least four developer units move in unison with one another to index successive developer units into the development zone. The developer units translate horizontally to develop successive latent images. The first developer unit, third developer, fourth developer unit and second developer unit are indexed sequentially into the development zone to develop the first, second, third, and fourth latent images, respectively.

12 Claims, 2 Drawing Sheets

DEVELOPMENT MODULE FOR A COLOR PRINTER

This invention relates generally to a color electrophotographic printing machine, and more particularly concerns an ordered sequence of indexing developer units into a development zone to maximize productivity.

In an electrophotographic printing machine, a photoconductive member is charged to a substantially uniform potential to sensitize the surface thereof. The charged portion of the photoconductive member is exposed. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a powder image on the photoconductive member which is subsequently transferred to a copy sheet. The copy sheet is heated to permanently affix the marking particles thereto in image configuration.

Multi-color electrophotographic printing is substantially identical to the foregoing process of black and white printing. However, rather than forming a single latent image on the photoconductive surface, successive latent images corresponding to the different colors desired in the copy. Each single color electrostatic latent image is developed with the appropriately colored toner. The single color toner images are transferred to the copy sheet in superimposed registration with one another. This creates a multi-layered toner image on the copy sheet. Thereafter, the multi-layered toner image is permanently affixed to the copy sheet creating a color copy. The developer material may be a liquid material or a powder material.

Generally, development systems used in multi-color printing machines have four individual developer unit. One of the developer units is operative with the other developer units being non-operative. A different developer units is operative to develop each latent image. In this way, each latent image is developed with a different color toner. It is desirable to minimize the distance that the developer units move between the operative and non-operative position. This reduces the space between successive latent images increasing machine productivity. Preferably, the developer units are customer replaceable units. In addition, it is necessary to minimize the escape of toner from the developer units to maintain a clean printing machine. Contamination to and from the developer units will degrade copy quality. In a multipass photoconductive drum type of architecture, the developer units have to be brought to the development zone to develop the latent images. In one type of arrangement, the developer units are arranged in a turret wheel configuration. The turret wheel is indexed 90° between successive latent images so that all of the images are developed in one revolution of the turret. However, when a developer unit is in the upside down position, the gravity force may cause toner fallout. Moreover, the centrifugal force exerted on the toner during indexing may also cause toner particles to scatter contaminating the components of the printing machine. This problem is solved by having the developer units translate horizontally. The developer units are moved sequentially into the development zone. The development cycle heretofore used for translating developer unit is advanced the developer units sequentially through the development zone. The order was to advance the first through the fourth developer units into the development zone in sequence. After the fourth developer unit has been positioned in the development zone, all of the developer units are translated or retraced to position the first developer unit in the development zone for the start of the next development cycle. This translational arrangement solves the toner fallout problem, the requirement to retrace after each cycle reduces productivity. Various types of development systems have hereinbefore been used as illustrated by the following disclosures, which may be relevant to certain aspects of the present invention:

U.S. Pat. No. 3,797,930
Patentee: Tanaka et al.
Issued: Mar. 19, 1974.

U.S. Pat. No. 4,841,329
Patentee: Kasamura et al.
Issued: June 20, 1989.

U.S. Pat. No. 4,841,336
Patentee: Kasamura et al.
Issued: June 20, 1989.

Co-pending U.S. patent application Ser. No. 07/485,011
Applicant: Borostyan.
Filed: Feb. 26, 1990.

The relevant portions of the foregoing patents may be briefly summarized as follows:

U.S. Pat. No. 3,797,930 discloses an electrophotographic printing machine having a plurality of developer units which move beneath a drum having a sheet with a latent image recorded thereon. Each developer unit contains a different color liquid developer material. The developer units are independent of one another so as to prevent mixing of colors.

U.S. Pat. No. 4,841,329 and U.S. Pat. No. 4,841,336 describe an image forming apparatus which accommodates a plurality of developer devices arranged substantially vertically. A first drive mechanism moves the developing devices vertically to position a selected developer unit at a predetermined location. At the predetermined location, the selected developer unit is moved horizontally to position it adjacent an image bearing member Successive developer units advance vertically to the predetermined location.

Co-pending U.S. patent application Ser. No. 07/485,011 discloses an electrophotographic printing machine having a plurality of developer units which move beneath a drum having a latent image recorded thereon. Each developer unit contains different color toner. The developer units index horizontally in unison with one another to position successive developer units adjacent the photoconductive drum in the development zone.

Pursuant to the features of the present invention, there is provided a apparatus for developing successive latent images recorded on a photoconductive member with different color toner at a development zone. The apparatus includes at least four developer units adapted to move in unison with one another. Each developer unit develops a latent image recorded on the photoconductive member with a different color toner. Means are provided for moving the developer units in an ordered sequence during each development cycle. The first developer unit is the first developer unit positioned in the development zone during the development cycle. The second developer unit, located adjacent the first developer unit, is the fourth unit positioned in the development zone during the development cycle. The third developer unit, located adjacent the second developer unit, is the second developer unit positioned in the development zone during the development cycle. The fourth developer unit, located adjacent the third developer unit, is the third developer unit positioned in the development zone during the development cycle.

In another aspect of the present invention, there is provided a printing machine of the type in which successive latent images recorded on a photoconductive member are developed with different color toner at a development zone. The printing machine includes at least four developer units adapted to move in unison with one another. Each developer unit develops the latent image recorded on the photoconductive member with a different color toner. Means are provided for moving the developer units in an ordered sequence during each development cycle. The first developer unit is the first developer unit positioned in the development zone during the development cycle. The second developer unit, located adjacent the first developer unit, is the fourth developer unit positioned in the development zone during the development cycle. The third developer unit, located adjacent the second developer unit, is the second developer unit positioned in the development zone during the development cycle. The fourth developer unit, located adjacent the third developer unit, is the third developer unit positioned in the development zone during the development cycle.

Other aspects of the present invention will become apparent as the following description proceeds and upon reference to the drawings, in which.

Figure 3:
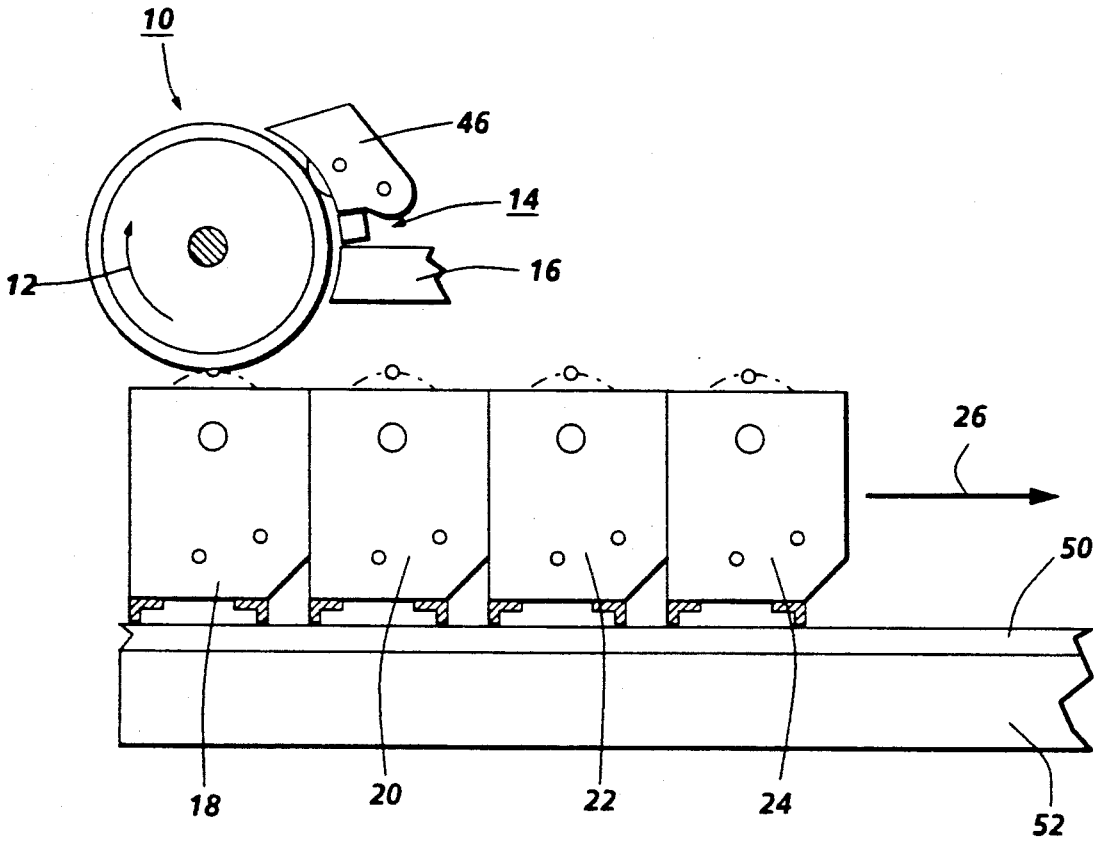
Figure 4:
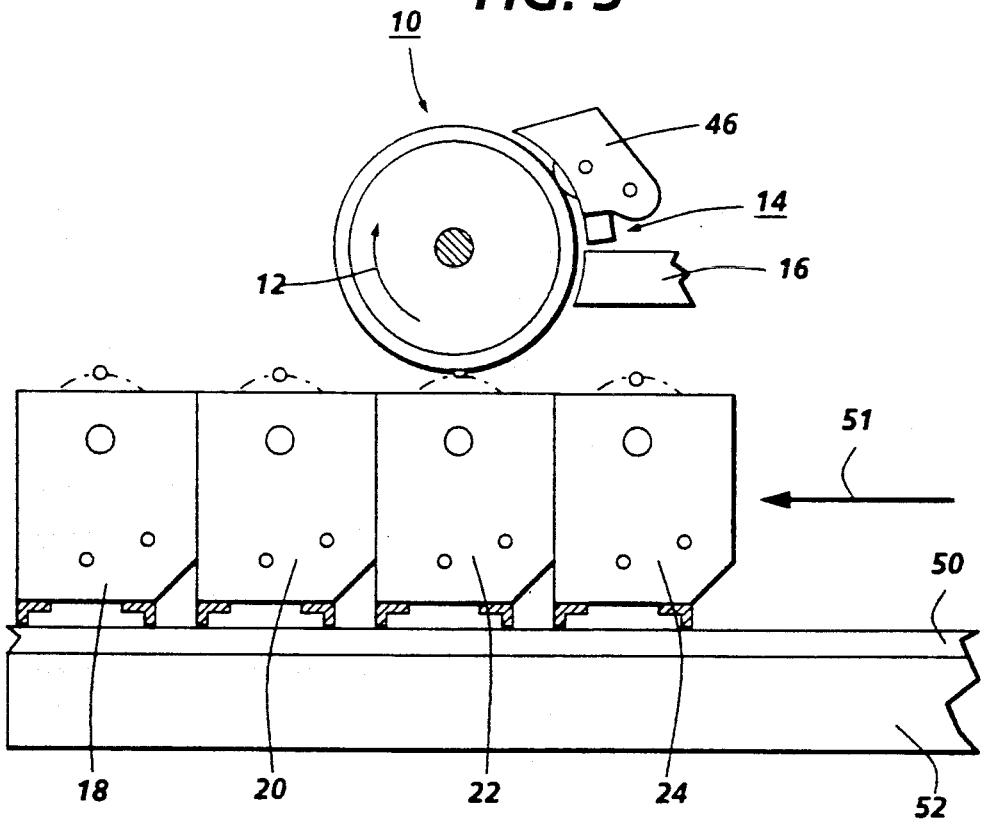

FIG. 3 is a schematic elevational view showing the fourth developer unit in the development zone; and FIG. 4 is a schematic elevational view showing the second developer unit in the development zone While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
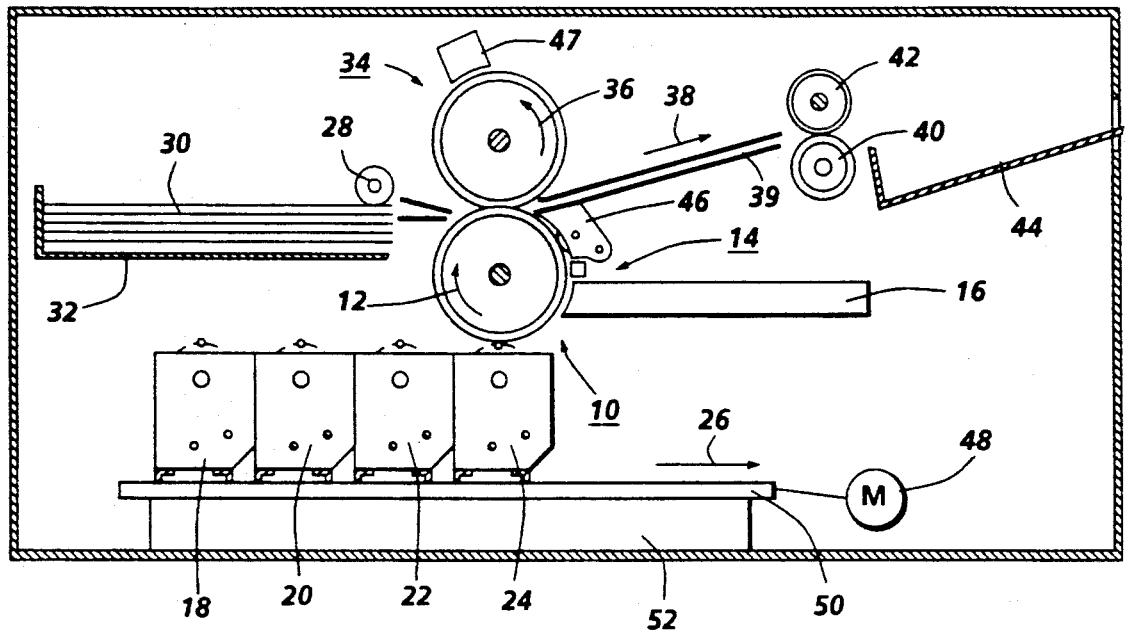
FIG. 1 is a schematic elevational view illustrating a color electrophotographic printing machine showing the first developer unit in the development zone.

For a general understanding of the features of the present invention, reference is made to the drawings. In the drawings, like references have been used throughout to designate identical elements. FIG. 1 depicts a color electrophotographic printing machine incorporating the features of the present invention therein. It will become evident from the following discussion that the present invention is equally well suited for use in a wide variety of printing machines, and is not necessarily limited in its application to the particular machine shown herein.

Turning initially to FIG. 1, there is shown a color electrophotographic printing machine employing a photoconductive drum 10. Preferably, photoconductive drum 10 is made from a photoconductive material such as selenium. However, any suitable photoconductive material may be used. Drum 10 rotates in the direction of arrow 12 to advance successive portions of the photoconductive surface sequentially through the various processing stations disposed about the path of movement thereof.

Initially, a portion of photoconductive drum 10 passes through the charging station. At the charging station, a corona generating devices, indicated generally by the reference numeral 14 charges photoconductive drum 10 to a relatively high, substantially uniform potential.

Next, the charged photoconductive surface is rotated to the exposure station. The exposure station includes an electronic subsystem that transmits a set of signals corresponding to a series of raster scan lines of different colors for the copy. These signals are transmitted to a raster output scanner (ROS) 16. ROS 16 includes a laser with rotating polygon mirror blocks. Preferably, a nine facet polygon is used. The ROS illuminates the charged portion of photoconductive drum 10 at a rate of about 400 pixels per inch. The ROS will expose the photoconductive drum to record four latent images. A person skilled in the art will appreciate that other imaging devices may be used in lieu of the ROS, e.g. an image bar. One latent image is adapted to be developed with cyan developer material. Another latent image is adapted to be developed with magenta developer material with the third latent image being developed with yellow developer material, and the fourth latent image being developed with black developer material. The latent images formed by the ROS on the photoconductive drum correspond to the signals from the electronic subsystem.

Figure 2:
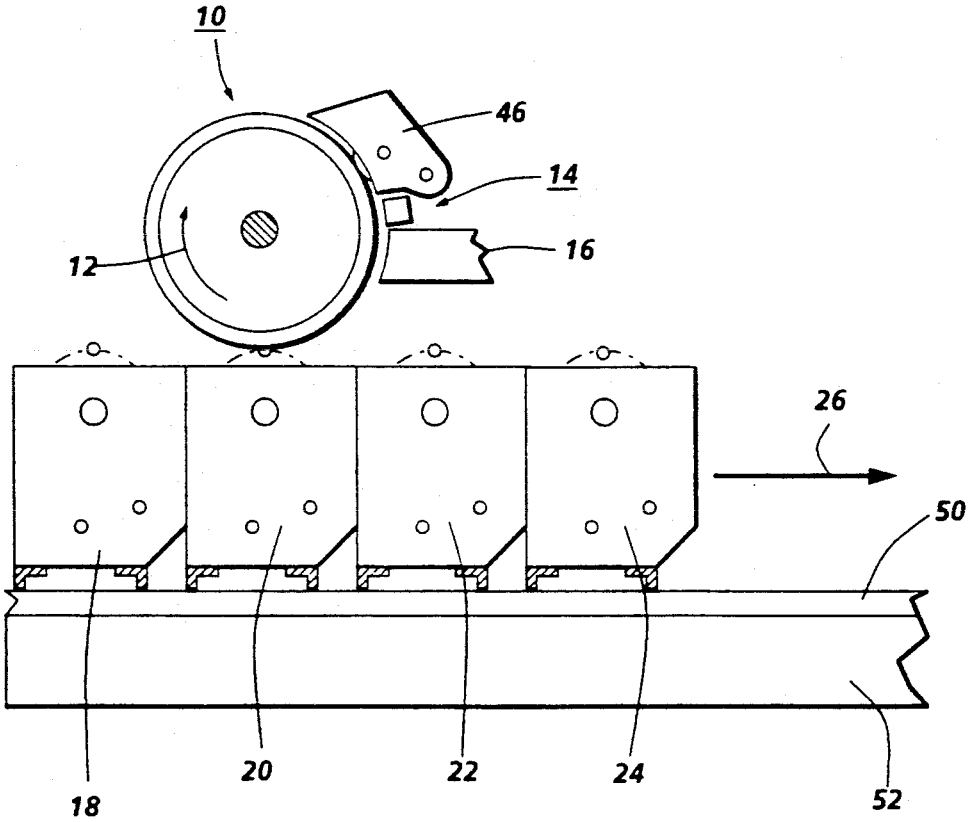
FIG. 2 is a schematic elevational view showing the third developer unit in the development zone.

After the electrostatic latent image has been recorded on photoconductive drum 10, drum 10 advances the electrostatic latent image to the development station. The development station includes four individual developer units generally indicated by the reference numerals 18, 20, 22 and 24. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 18, 20 and 22, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive drum corresponding to the green regions will record the red and blue portions as areas of relatively high charge density on photoconductive drum 10, while the green areas will be reduced to a voltage level ineffective for development. The charged areas are then made visible by having developer unit 20 apply green absorbing (magenta) toner particles onto the electrostatic latent image recorded on photoconductive drum 10. Similarly, a blue region is developed by developer unit 18 with blue absorbing (yellow) toner particles, while the red region is developed by developer unit 24 with red absorbing (cyan) toner particles. Developer unit 22 contains black toner particles and may be used to develop the electrostatic latent image formed from a black and white original document, or used in conjunction with the other three developer units to develop those regions of the copy which are black. In this later instance, a latent image is recorded on the photoconductive drum corresponding to those regions being printed in black. Each of the developer units is moved into and out of the operative position. In the operative position, the developer unit is in the development zone with the magnetic brush being closely adjacent and self spaced from the photoconductive drum, while, in the non-operative position, the magnetic brush is spaced therefrom. During development of each electrostatic latent image only one developer unit is in the operative position, the remaining developer units are in the non-operative position. This insures that each electrostatic latent image is developed with toner particles of the appropriate color without co-mingling. In FIG. 1, developer unit 24 (which corresponds to the first developer unit) is shown in the operative position with developer units 18, 20 and 22 being in the non-operative position. Developer unit 24 is located at one end of the development system with developer unit 18 (corresponding to the fourth developer unit) being located at the other end of the development system. Developer unit 22 (which corresponds to the second developer unit) is interposed between developer unit 24 and developer unit 20. Developer unit 20 (which corresponds to the third developer unit) is interposed between developer unit 22 and developer unit 18. All of the developer units are mounted on a carriage 50. A motor 48 coupled to developer carriage 50 translates the developer units in unison with one another so that developer units are positioned at the development zone in an ordered sequence. A housing 52 having a chamber therein, is mounted beneath developer carriage 50 for storing waste toner. After the first latent image is developed by developer unit 24, motor 48 coupled to developer carriage 50 translates the developer units in a horizontal direction, as indicated by arrow 26, to position developer unit 20 (corresponding to the third developer unit) in the development zone. The developer units move in an ordered sequence to maximize productivity. FIGS. 2 through 4, inclusive, show the ordered sequence of translation of the developer units.

With continued reference to FIG. 1, after development, the toner image is moved to the transfer station where the toner image is transferred to a sheet of support material, such as plain paper amongst others. At the transfer station, the sheet feeder, indicated generally by the reference numeral 28, separates the uppermost sheet from a stack of sheets 30 supported on tray 32. The sheet is advanced to a transfer drum, indicated generally by the reference numeral 34, and secured removably thereon by sheet grippers holding the leading edge of the sheet. Transfer drum 34 is coupled by gears to rotate in synchronism with drum 10 in the direction of arrow 36. A voltage source (not shown) electrically biases transfer drum 34 to attract the toner image from photoconductive drum 10 to the sheet. This occurs as the sheet moves into the nip defined by transfer drum 34 and photoconductive drum 10. The sheet remains secured to the transfer drum so as to move in a recirculating path for four cycles. In this way, four different color toner images are transferred to the sheet in superimposed registration with one another. Each of the electrostatic latent images recorded on the photoconductive surface are developed with the appropriately colored toner which is transferred to the sheet to form the multi-color copy. After the last transfer operation, the grippers open and release the sheet. At this time a cleaning unit 47 having a cleaning brush or cleaning blade is articulated from the non-operative position to the operative position where the brush contacts the transfer drum to remove particles therefrom. This insures that particles are not transferred to the backside of the sheet.

A vacuum conveyor transport 39 advances the sheet, in the direction of arrow 38, to the fusing station where the transferred image is permanently fused to the sheet. The fusing station includes a heated fuser roll 40 and a pressure roll 42. The sheet passes through the nip defined by fuser roll 40 and pressure roll 42. The toner image contacts fuser roll 40 so as to be affixed to the sheet. Thereafter, the sheet is advanced by a conveyor to catch tray 44 for subsequent removal therefrom by the machine operator.

A blade cleaner, indicated generally by the reference numeral 46, contacts drum 10 after the toner image has been transferred to the sheet. The blade cleaner contacts the photoconductive drum when there is no toner image thereon so as to remove residual toner particles remaining after the transfer operation. Any residual charge remaining on the photoconductive drum is also removed therefrom prior to the start of the next successive cycle by illuminating drum 10.

Referring now to FIG. 2, there is shown developer unit 20 (corresponding to the third developer unit) in the development zone to develop the second latent image recorded on photoconductive drum 10. Developer unit 20 develops the second latent image with magenta toner particles. After the second electrostatic latent image is developed with magenta toner particles, motor 48 is actuated to translate carriage 50 in the direction of arrow 26 so as to index developer unit 18 into the development zone.

Turning now to FIG. 3, there is shown developer unit 18 (corresponding to the fourth developer unit) in the development zone to develop the third latent image recorded on photoconductive drum 10. Developer unit 18 develops the third latent image with yellow toner particles. After the third electrostatic latent image is developed with yellow toner particles, motor 48 is actuated to translate carriage 50 in the direction of arrow 52 (FIG. 4) so as to index developer unit 22 into the development zone. Developer unit 22 is shown in the development zone in FIG. 4.

Referring to FIG. 4, there is shown developer unit 22 (corresponding to the second developer unit) in the development zone to develop the fourth latent image recorded on photoconductive drum 10. Developer unit 22 develops the fourth latent image with black toner particles. After the fourth electrostatic latent image is developed with black toner particles, motor 48 is actuated to translate carriage 50 in the direction of arrow 51 so as to index developer unit 24 into the development zone. In this way, the development cycle is repeated without the necessity to retrace. This improves productivity by as much as 33%.

In recapitulation, the apparatus of the present invention develops successive latent images recorded on a photoconductive member with different color toner. Developer units containing different color toner are indexed horizontally from a non-operative position to an operative position in the development zone in an ordered sequence. The first, third, fourth and second developer units are successively moved into the development zone during each development cycle. This indexing sequence maximizes productivity.

It should be understood that the indexing sequence of the present invention is not limited to an electrophotographic printing machine having only four developer units but instead includes any apparatus having at least four developer units.

It is, therefore, evident that there has been provided in accordance with the present invention, an apparatus for developing successive latent images with different color toner that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

We claim:

1. An apparatus for developing latent images recorded on a photoconductive member with different color toner at a development zone, including:

at least four developer units adapted to move in unison with one another, each developer unit develops the latent image recorded on the photoconductive member with a different color toner; and means for moving said developer units in an ordered sequence during each development cycle with the first developer unit being the first developer unit positioned in the development zone during the development cycle, the second developer unit, located adjacent the first developer unit, being the fourth developer unit positioned in the development zone during the development cycle, the third developer unit, located adjacent the second developer unit, being the second developer unit positioned in the development zone during the development cycle, and the fourth developer unit, located adjacent the third developer unit, being the third developer unit positioned in the development zone during the development cycle.

2. An apparatus according to claim 1, wherein said moving means translates said developer units to position the developer units adjacent the development zone in the ordered sequence during each cycle.

3. An apparatus for developing latent images recorded on a photoconductive member with different color toner at a development zone, including:

a plurality of developer units adapted to move in unison with one another, each developer unit develops the latent image recorded on the photoconductive member with a different color toner; and means for moving said developer units in an ordered sequence, said moving means further translates and indexes horizontally said developer units to position the developer units adjacent the development zone in the ordered sequence during each development cycle with a first of said plurality of developer units being the first developer unit positioned in the development zone during the development cycle, a second of said plurality of developer units, located adjacent the first developer unit, being the fourth developer unit positioned in the development zone during the development cycle, a third of said plurality of developer units, located adjacent the second developer unit, being the second developer unit positioned in the development zone during the development cycle, and a fourth of said plurality of developer units, located adjacent the third developer unit, being the third developer unit positioned in the development zone during the development cycle.

4. An apparatus according to claim 3, wherein said moving means indexes horizontally said developer units through the ordered sequence for successive development cycles.

5. An apparatus according to claim 3, wherein:

said first developer unit is located at one end of said developer units;

said fourth developer unit is located at the other end of said developer units;

said second developer unit is interposed between said third developer unit and said first developer unit; and said third developer unit is interposed between said second developer unit and said fourth developer unit.

6. An apparatus according to claim 5, wherein said moving means includes:

means for supporting said developer units horizontally adjacent to one another; and drive means for moving said supporting means in a horizontal direction to locate developer units in the development zone in the ordered sequence for each development cycle.

7. A printing machine of the type in which successive latent images recorded on a photoconductive member are developed with different color toner at a development zone, including:

at least four developer units adapted to move in unison with one another, each developer unit develops the latent image recorded on the photoconductive member with a different color toner; and means for moving said developer units in an ordered sequence during each development cycle with the first developer unit being the first developer unit positioned in the development zone during the development cycle, the second developer unit, located adjacent the first developer unit, being the fourth developer unit positioned in the development zone during the development cycle, the third developer unit, located adjacent the second developer unit, being the second developer unit positioned in the development zone during the development cycle, and the fourth developer unit, located adjacent the third developer unit, being the third developer unit positioned in the development zone during the development cycle.

8. A printing machine according to claim 7, wherein said moving means translates said developer units to position the developer units adjacent the development zone in the ordered sequence during each cycle.

9. A printing machine of the type in which successive latent images recorded on a photoconductive member are developed with different color toner at a development zone, including:

a plurality of developer units adapted to move in unison with one another, each developer unit develops the latent image recorded on the photoconductive member with a different color toner; and means for moving said developer units in an ordered sequence, said moving means further translates and indexes horizontally said developer units to position the developer units adjacent the development zone in the ordered sequence during each development cycle with a first of said plurality of developer units being the first developer unit positioned in the development zone during the development cycle, a second of said plurality of developer units, located adjacent the first developer unit, being the fourth developer unit positioned in the development zone during the development cycle, a third of said plurality of developer units, located adjacent the second developer unit, being the second developer unit positioned in the development zone during the development cycle, and a fourth of said plurality of developer units, located adjacent the third developer unit, being the third developer unit positioned in the development zone during the development cycle.

10. A printing machine according to claim 9, wherein said moving means indexes horizontally said developer units through the ordered sequence for successive development cycles.

11. A printing machine according to claim 9, wherein:

said first developer unit is located at one end of said developer units;

said fourth developer unit is located at the other end of said developer units;

said second developer unit is interposed between said third developer unit and said first developer unit; and said third developer unit is interposed between said second developer unit and said fourth developer unit.

12. A printing machine according to claim 11, wherein said moving means includes:

means for supporting said developer units horizontally adjacent to one another; and drive means for moving said supporting means in a horizontal direction to locate developer units in the development zone in the ordered sequence for each development cycle.

* * * * *